United States Patent [19]

Brooks

[11] 4,174,858

[45] Nov. 20, 1979

[54] CONNECTION FOR SECURING A HELICALLY CONVOLUTED HOSE TO A HOSE FITTING

[75] Inventor: Joseph F. Brooks, Bloomington, Ill.

[73] Assignee: National Union Electric Corporation, Greenwich, Conn.

[21] Appl. No.: 747,549

[22] Filed: Dec. 6, 1976

[51] Int. Cl.[2] ..... F16L 33/00

[52] U.S. Cl. ..... 285/7; 285/239; 285/390; 285/DIG. 4

[58] Field of Search ..... 285/DIG. 4, 239, 251, 285/391, 7, 390, 238, 92, 334; 151/22; 85/47

[56] References Cited

U.S. PATENT DOCUMENTS

| | | | |
|---|---|---|---|
| 884,461 | 4/1908 | Browne | 285/251 |
| 928,237 | 7/1909 | Baird | 285/239 |
| 1,088,892 | 3/1914 | Foreman | 85/47 |
| 1,947,593 | 2/1934 | Hamilton | 285/251 |
| 3,078,109 | 2/1963 | Jackson et al. | 285/251 |
| 3,262,718 | 7/1966 | Draudt | 285/7 |
| 3,393,267 | 7/1968 | Busse | 285/390 X |
| 3,727,949 | 4/1973 | Kleykamp et al. | 285/7 |
| 3,813,115 | 5/1974 | French | 285/391 X |
| 3,992,044 | 11/1976 | Muslin | 285/251 X |

FOREIGN PATENT DOCUMENTS

| | | | |
|---|---|---|---|
| 2332846 | 1/1975 | Fed. Rep. of Germany | 285/251 |
| 148792 | 2/1955 | Sweden | 285/251 |

*Primary Examiner*—Thomas F. Callaghan
*Attorney, Agent, or Firm*—Merriam, Marshall & Bicknell

[57] ABSTRACT

A connection for securing one end of a helically convoluted suction hose to a hose fitting such as is used to effect rapid engagement of the hose with or disengagement thereof from the suction inlet of a vacuum cleaner. The fitting includes a tubular portion having external threads of the same pitch as the unstressed convolutions of the hose so that the tubular portion can be threaded into the end of the hose. The cross sectional configuration of the threads is such as to resist relative rotation between the fitting and the end of the hose when the threads are engaged with the hose convolutions. Additional resistance to relative rotation between the fitting and end of the hose is provided by a collar at the inner end of the tubular portion, the collar serving as an abutment to cause compression and a reduction in the pitch of the convolutions of the hose between the threads and collar with continued threading of the fitting into the end of the hose after the end edge of the hose has engaged the collar. Barbs on the threads substantially increase the resistance to rotation of the fitting relative to the end of the hose in a direction to effect unthreading of these parts, the barbs being provided by sharp transverse edges and corners on the threads. Removal of the remnant of the hose remaining on the tubular portion after the hose has been severed adjacent to the end of the tubular portion in order to replace or repair the hose is facilitated by interrupted portions of the threads, such interrupted portions permitting axial slitting of the hose remnant and removal thereof from the tubular portion.

13 Claims, 11 Drawing Figures

CONNECTION FOR SECURING A HELICALLY CONVOLUTED HOSE TO A HOSE FITTING

This invention relates to hose connections, and more particularly relates to a connection for securing one end of a helically convoluted, flexible hose to a hose fitting such as is used to connect a flexible suction hose to the suction inlet of a vacuum cleaner.

Various techniques and constructions have been heretofore developed and utilized to secure one end of a flexible hose to a hose fitting. In the field of commercial and household vacuum cleaners, for example, where flexible, convoluted hose is utilized to connect the suction inlet or port of the cleaner with a cleaning tool and where a fitting at one end of the hose permits rapid engagement of the hose with and disengagement thereof from the suction inlet, it has heretofore been the practice to secure the fitting to the end of the hose by cementing the parts together with a suitable adhesive. Mechanical connections, wherein the end of the hose is clamped around or otherwise held in surrounding engagement with the fitting, have also been used.

While the aforementioned cemented or mechanical connections provide a satisfactory joint between the end of a suction hose and hose fitting so that little or no suction loss occurs when the cleaner is in operation, such connections are difficult if not impossible to separate once made. In addition, the use of an adhesive increases the cost of the connection and is time consuming.

Accordingly, it is a general object of the present invention to provide a novel and improved hose connection for securing one end of a flexible hose to a hose fitting.

Another object is to provide a novel hose connection for securing one end of a helically convoluted, flexible hose to a hose fitting of the type adapted to be engaged with and disengaged from the suction inlet of a vacuum cleaner.

A further object is to provide a novel hose connection of the foregoing character, wherein at least a portion of one thread is provided on a tubular portion of the fitting to permit threaded engagement of the tubular portion into the end of the hose and wherein the thread portion causes deformation of at least a portion of the convolution with which it is engaged so that rotation of the tubular portion relative to the end of the hose is resisted.

Still another object is to provide a novel hose connection of the foregoing character, wherein barb means is provided on the thread portion to increase the resistance to rotation of the tubular portion of the fitting relative to the end the hose in a direction to effect disengagement of these parts.

A still further object is to provide a novel hose connection of the foregoing character, wherein a plurality of threads having interrupted portions are provided on the tubular portion of the fitting and barb means is provided at each interrupted portion.

A more particular object is to provide a novel hose connection of the character described, wherein at least a portion of one thread is provided on the tubular portion of the fitting and wherein a collar is provided on the tubular portion in spaced relation from the thread so that the pitch of at least one of the convolutions of the hose between the thread and collar is reduced relative to the pitch of the unstressed convolutions when the tubular portion is fully threaded into the end of the hose, thereby to increase the resistance to rotation of the tubular portion of the fitting relative to the end of the hose.

Still another object is to provide a novel hose connection of the character described which is simple in construction, economical to manufacture and reliable in operation.

These and other objects will become apparent from the following detailed description and accompanying drawing, wherein.

Figure 1:
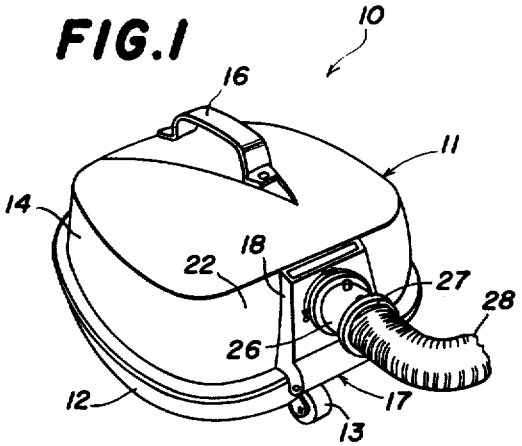
FIG. 1 is a perspective view of a suction cleaner and showing a portion of a suction hose connected to the suction inlet of the cleaner by a fitting incorporating a hose connection embodying the features of the present invention.

In FIG. 1, a suction cleaner, in the present instance a canister type suction cleaner 10, is illustrated. The cleaner 10 is conventional to the extent that it includes a casing 11 comprising a lower casing section 12 mounted on a plurality of wheels 13, only of one of which is shown in FIG. 1, and an upper casing section 14 having a carrying handle 16. The casing sections 12 and 14 are hingedly connected by a hinge structure, indicated generally at 17, which includes a generally rectangularly shaped housing 18 secured to an end wall 22 of the upper casing section 14 and overlying an opening (not shown) in the end wall 22. An opening (not shown) in the end wall 22 registers with an aligned opening (also not shown) in the housing 18 and defines a suction opening or inlet for the cleaner 10. The suction opening in the housing 18 is formed to receive the male portion, indicated at 25 in FIGS. 2 and 3, of a tubular hose fitting 26 secured to one end, indicated at 27, of a convoluted hose 28.

Coupling means including the male coupling portion 25 of the fitting 26 and a female coupling portion (not shown) associated with the suction opening in the housing 18, is provided for releasably retaining the fitting 26 in sealed relation with the suction opening so that suction generated by the cleaner 10 will be communicated through the hose 28 to the suction port of an associated cleaning tool (not shown) connected to the opposite end of the hose 28.

The coupling means utilized to detachably connect the fitting 26 with the suction opening of the cleaner 10 is preferably of the same construction as is disclosed and claimed in the William E. Hanold U.S. patent application Ser. No. 577,284 filed May 14, 1975, now U.S. Pat. No. 4,017,937, granted on Apr. 19, 1977 and assigned to the assignee of this application. Such coupling means thus includes a pair of diametrically spaced lugs 32 and 33 on a cylindrical section 34 of the male coupling portion 25, the lugs 32 and 33 being adapted to engage flanges (not shown) adjacent to the suction opening in the housing 18 and retain the male coupling portion 25 in the suction opening. A detent 36 is mounted between circumferentially spaced parts of the lug 32 and prevents disengagement of the male coupling portion 25 from the female coupling portion when these parts are fully engaged. A collar 38 on the fitting 26 is adapted to engage an annular, external sealing surface on the housing 18 and axially position the lugs 32 and 33 with respect to cooperating retaining surfaces on the flanges of the female coupling portion. A push button 37 is provided on the fitting 26 to permit a user to shift the detent 36 radially inwardly to a position permitting the fitting 26 to be rotated to a position free of the retaining surfaces on the flanges of the female coupling portion so that the fitting can be disengaged from the suction opening in the housing 18. It will be understood, however, that other structures could be utilized to permit detachable connection and disconnection of the fitting 26 from the suction opening of the cleaner 10.

Figure 3:
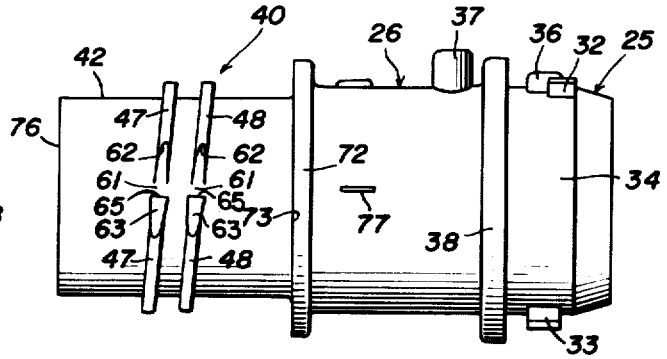
FIG. 3 is an elevational view of the opposite side of the hose fitting illustrated in FIG. 2.
Figure 2:
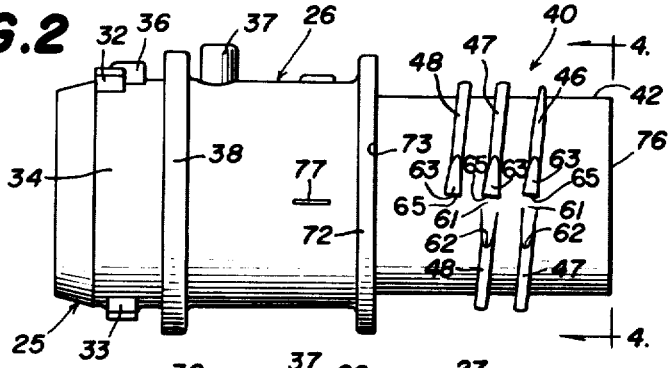
FIG. 2 is an elevational view of one side of a hose fitting embodying the features of the present invention.
Figure 4:
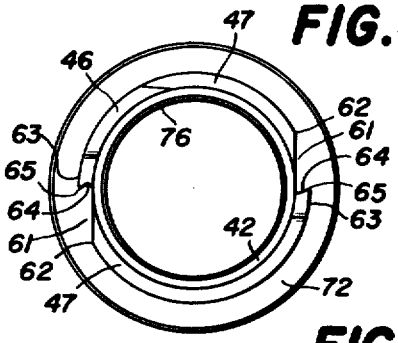
FIG. 4 is an end view taken along the line 4—4 of FIG. 2.

Referring now to FIGS. 2, 3 and 4, it will be seen that the fitting 26 includes a connection, indicated generally at 40, for securing the end 27 of the hose 28 to the fitting 26 or vice-versa. The connection 40, in the present instance, comprises a tubular portion or section 42 of the fitting 26 at the opposite end thereof from the male coupling portion 25. The tubular portion 42 is preferably cylindrical and has an outside diameter substantially equal to or somewhat less than the internal diameter of the suction hose 28 so that little or no suction loss will occur when these parts are engaged and the fitting 26 is connected to source of vacuum, such as the suction opening of the cleaner 10.

The connection 40 also comprises thread means in the form of at least a portion of one and preferably a plurality of threads on the external surface of the tubular portion 42. In the present instance, a portion 46 (about one quarter) of one thread and two complete threads 47 and 48 are provided on the tubular portion 42. The portion 46 and threads 47 and 48 have the same pitch as the pitch of the unstressed convolutions of the hose 28 so that the end 27 of the hose can be threaded onto the tubular portion 42, or vice-versa, by rotating one of these parts relative to the other in an appropriate direction. In the present instance, the thread portion 46 and threads 47 and 48 are left-handed as are the convolutions of the hose 28.

Figure 7:
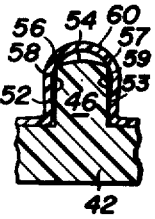
FIG. 7 is an enlarged, fragmentary cross sectional view through one of the threads of the hose fitting and hose illustrated in FIGS. 5 and 6 and showing the engaged relationship of the thread with a convolution of the hose.

According to the present invention, the thread portion 46 and threads 47 and 48 are generally rectangular in cross section, as shown in FIG. 7, which is an enlarged, cross sectional view through a full section of the thread portion 46. The thread portion 46, as well as the threads 47 and 48, thus have substantially parallel, radially extending sides 52 and 53 and a substantially flat or slightly convex top or crest 54. Thus, a pair of sharp edges 56 and 57 are defined at the intersections of the sides 52 and 53 with the top 54.

The width of the thread portion 46, as well as the threads 47 and 48, is preferably somewhat greater than the space between the inner surfaces, indicated at 58 and 59 of each convolution, indicated at 60, of the hose 28 so that the edges 56 and 57 of the thread 46, and likewise the threads 47 and 48, engage the inner surfaces 58 and 59 with a substantial degree of friction. Consequently, a substantial amount of counterclockwise or clockwise torque has to be applied to the fitting 26 or hose 28 in order to effect threading of the tubular portion 42 into or out of the end 27 of the hose 28.

Resistance to relative clockwise movement between or unthreading of the fitting 26 from the end 27 of the hose 28 is substantially increased by the provision of barb means on at least a portion of one and preferably on each of the threads 47 and 48, and thread portion 46. To this end, the thread portion 46 and threads 47 and 48 are interrupted or cut away, as at 61, to define leading and trailing ends, indicated at 62 and 63, respectively in FIGS. 2–4, inclusive, 8 and 9, the trailing ends 63 being undercut as at 64 (FIG. 4) to define sharp edges 65 at the trailing ends 63, which extend transversely to the thread portion 46 and threads 47 and 48. The sharp edges 65 or barb means at the trailing ends 63 of the threads dig into the interior of the convolutions of the hose which are engaged with the threads and thus further serve to resist relative rotation between the fitting 26 and hose end 27 in a direction to cause unthreading of these parts.

Figure 5:
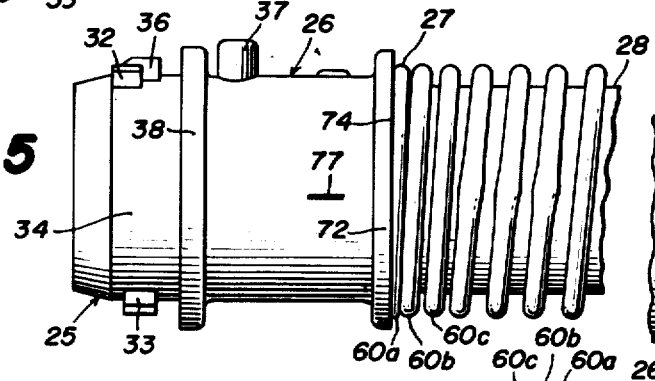
FIG. 5 is an elevational view of the hose fitting illustrated in FIG. 2 as the latter would appear when one end of a convoluted suction hose is fully engaged with the fitting.
Figure 6:
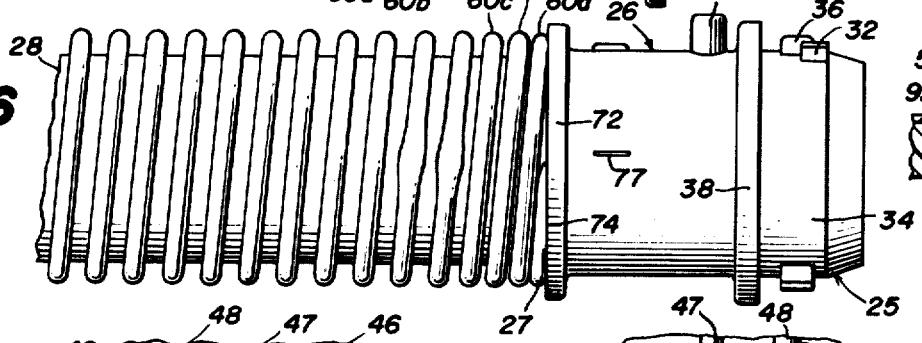
FIG. 6 is a view similar to FIG. 5, but showing the opposite side of the fitting and a portion of the suction hose shown in FIG. 5.
Figure 8:
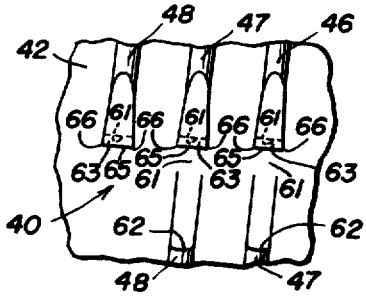
FIG. 8 is an enlarged fragmentary elevational view of a portion of the hose fitting illustrated in FIG. 2.
Figure 9:
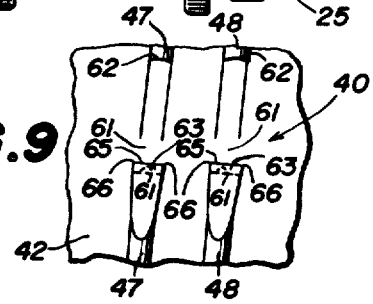
FIG. 9 is an enlarged fragmentary elevational view of a portion of the hose fitting illustrated in FIG. 3.

Additional resistance to relative rotation between the fitting 26 and hose 28 in a clockwise direction or in a direction to cause unthreading of these parts results from the fact that the trailing ends 63 of the threads are wider or have a greater transverse width than the other portions of the threads and the space between the inner, radially extending surfaces 58 and 59 of the hose convolutions 60. Consequently, the corners, indicated at 66 in FIGS. 8 and 9, of the trailing ends 63 will dig into the inner surfaces 58 and 59 of the convolutions and resist relative rotation between the fitting 26 and hose 28 in a clockwise or unthreading direction. Since the corners 66 at the trailing end 63 of each thread are transversely spaced a greater distance than the space between the inner surfaces 58 and 59, the side walls of the convolution 60 in the vicinity of the trailing ends 63 are bulged outwardly, as shown in FIGS. 5 and 6.

A substantial increase in the resistance to relative rotation between the fitting 26 and hose 28 in a clockwise or direction to unthread these parts when the latter are fully engaged is obtained by the provision of an abutment in the form of an annular collar 72 on the fitting 26 at the axially inner end, indicated at 73, of the tubular portion 42. Since the collar 72 is spaced axially inwardly from the thread 48, at least one and preferably a plurality of the convolutions adjacent to the end 27 of the hose 28 will be compressed when the tubular portion 42 of the fitting 26 has been threaded fully into the end 27 of the hose 28. Such compression of the convolutions of the hose between the collar 72 and thread 48 occurs after the end edge, indicated at 74 in FIGS. 5 and 6, engages the collar 72 and some additional relative counterclockwise rotation of these parts is effected.

Compression of the convolutions of the hose between the collar 72 and thread 48 takes place because of the resiliency of the material of the hose 28 and causes the pitch of these intermediate convolutions to be reduced with respect to the pitch of the thread portion 46 and threads 47 and 48. Consequently, any force or vibration tending to unthread the fitting 26 from the hose 28, or vice versa, is further resisted by the dissimilar pitch of the compressed convolutions of the hose 28 between the thread 48 and collar 72 with respect to the pitch of the thread portion 46 and threads 47 and 48. The aforementioned compressed convolutions are indicated at 60*a*, 60*b* and 60*c* in FIGS. 5 and 6.

Assuming that the tubular portion 42 of the fitting 26 has been threaded into the end 27 of the hose 28 and that, for some reason, it becomes necessary to replace either the fitting 26 or hose 28, separation of these parts is effected in the following manner. Initially, the hose 28 is severed adjacent to the axially outer end, indicated at 76, of the tubular portion 42 in any convenient manner, such as by cutting through the hose with a knife or scissors. The remnant of the hose left on the tubular portion 42 is then removed by slitting the remnant axially and in the vicinity of either of the interrupted portions 61 of the threads 46 and 47. To this end, a pair of diametrically spaced index marks 77 (FIGS. 2–5, inclusive) may be provided on the fitting 26 to facilitate locating the interrupted portions 61 of the threads 46 and 47.

If, as is frequently the case, the hose 28 tears adjacent the outer end 76 of the tubular portion 42, the remainder of the hose may be reused after removal of the remnant from the tubular portion 42 of the fitting and after the end of the hose has been squared off at the break so that a substantial portion of the end edge 74 of the hose will contact the collar 72 when the tubular portion 42 of the fitting is again threaded into the end of the hose.

Figure 10:
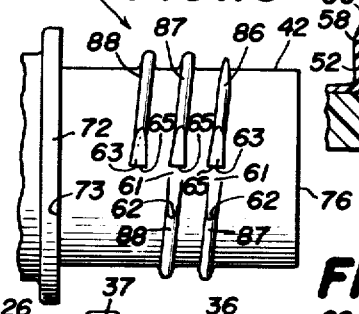
FIG. 10 is an elevational view, similar to FIG. 2, of a portion of another hose fitting embodying the features of the present invention.
Figure 11:
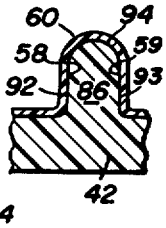
FIG. 11 is an enlarged, fragmentary cross sectional view showing the engaged relation of one of the convolutions of a suction hose and one of the threads of the hose fitting illustrated in FIG. 10.

Referring now to FIG. 10, an alternate hose connection 80 is illustrated, like reference numerals being used to identify the parts thereof identical with those of the hose connection 40. The hose connection 80 differs from the connection 40 only in that the cross sectional shape of the threads on the tubular portion 42 is different from that of the thread portion 46 and threads 47 and 48. Thus, the threads of the connection 80, which include a thread portion 86 and threads 87 and 88, while having substantially parallel, radially extending sides 92 and 93, have rounded tops or crests 94 as shown in FIG. 11, which is an enlarged cross sectional view through the thread portion 86. The rounded tops 94 of the thread portion 86 and threads 87 and 88, while more closely conforming to the inner contour of the convolutions 60 of the hose 28 than the thread portion 46 and threads 47 and 48 of the connection 40, also offer resistance to relative rotation between the threads and convolutions of the hose during engagement of the tubular portion 42 with the end 27 of the hose. The thread portion 86 and threads 87 and 88 are otherwise the same as the thread portion 46 and threads 47 and 48 of the connection 40.

While only two embodiments of the invention have been herein illustrated and described, it will be understood that modifications and equivalent structures may be developed which fall within the scope of the appended claims.

I claim:

1. A connection for securing one end of a helically convoluted resilient hose to a hose fitting, each of the convolutions of said hose having inner surfaces defined by a pair of axially spaced, substantially radially extending side walls and a connecting end wall, and said fitting including a tubular portion extending into one end of said hose, said connection comprising at least a portion of one thread on the exterior of said tubular portion and having a pitch substantially the same as the pitch of the unstressed convolutions of said hose, said thread portion having substantially radially extending side walls and a substantially flat top so as to define a sharp edge at the intersection of each side wall with said top, said sharp edges frictionally engaging the inner surfaces of at least a portion of one of the convolutions of said hose, said thread portion also having spaced leading and trailing ends with respect to the relative direction of rotation of said tubular portion and said one end of said hose as these parts are being engaged, and barb means carried at the trailing end of said thread portion, said barb means comprising a sharp edge on the trailing end of said thread portion, said sharp edge extending transversely to said thread portion and being wider than said thread portion, the transverse width of said sharp edge also being greater than the internal width of the convolutions of said hose so that said sharp edge digs into the interior of at least one of the convolutions of said hose, whereby relative rotation between said one end of said hose and said tubular portion in a direction to effect disengagement of these parts is resisted when said thread portion is engaged with said portion of said convolution.

2. The hose connection of claim 1, in which the distance between the edges of said thread portion is greater than the space between the inner surfaces of the side walls of a convolution of said hose when said convolution is in an unstressed condition, whereby the portion of the convolution engaged by said thread portion is expanded when said thread portion is engaged with said portion of said convolution.

3. The hose connection of claim 1, in which a plurality of threads are provided on the exterior of said tubular portion, each of said threads has a pitch substantially the same as the pitch of the unstressed convolutions of said hose, and each of said threads has substantially radially extending side walls and a substantially flat top so as to define sharp edges at the intersections of the side walls and top of each thread, said sharp edges frictionally engaging the convolutions of said hose and increasing the resistance to relative rotation between said tubular portion of said fitting and said one end of said hose.

4. The hose connection of claim 1, in which said sharp edge is defined by an undercut in said thread portion at said trailing end.

5. The hose connection of claim 1, in which two transversely spaced corners are defined on said trailing end of said thread portion at each end of said sharp edge, said corners digging into the interior of one of the convolutions of said hose and increasing said resistance to rotation of said one end of said hose relative to said tubular portion in said direction effecting disengagement of said parts.

6. The hose connection of claim 1, in which at least one thread is provided on the exterior of said tubular portion and at least two substantially diametrically spaced sharp edges are provided on said one thread.

7. The hose connection of claim 1, in which a plurality of threads are provided on the exterior of said tubular portion, each of said threads has a pitch substantially the same as that of the convolutions of said hose and at least a portion of each thread is removed to define leading and trailing ends adjacent to said removed portion, and a transversely extending sharp edge is provided on the trailing end of each of said threads.

8. The hose connection of claim 7, in which at least two complete threads are provided on the exterior of said tubular portion, at least two portions of each thread are removed to define two pairs of leading and trailing ends on each thread, and a transversely extending sharp edge is provided on each of said trailing ends.

9. The hose connection of claim 8, in which about two and one quarter threads are provided on the exterior of said tubular portion so that five trailing ends are defined on said tubular portion.

10. A connection for securing one end of a helically convoluted flexible hose to a hose fitting, said connection comprising a fitting having a tubular portion extending into one end of said hose, said tubular portion having thread means on the exterior thereof and being threadable into the convolutions of said end of said hose in response to rotation of said tubular portion relative to said end in a direction to effect engagement of these parts, said thread means including at least a portion of one thread on said tubular portion, said thread portion having a transverse width substantially equal to the internal width of the convolutions of said hose, said thread portion also having barb means which digs into the interior of at least one of the convolutions of said hose so as to resist rotation of said one end of said hose relative to said tubular portion in a direction to effect disengagement of these parts, and an abutment on the exterior of said tubular portion and spaced inwardly from said thread portion, said abutment engaging the end edge of said hose and causing compression and a change in the pitch of a plurality of the convolutions of said hose between said portion of said thread and said abutment with continued rotation of said tubular portion relative to the end of said hose after said end edge has engaged said abutment, whereby said barb means and the change in pitch of the compressed convolutions of said hose between said abutment and said thread portion increases the resistance to rotation of said one end of said hose relative to said tubular portion in a direction to effect disengagement of these parts.

11. The hose connection of claim 10, in which the tubular portion of said hose fitting has axially inner and outer ends, said thread portion is located intermediate said ends, and said abutment is located at said inner end.

12. The hose connection of claim 11, in which said thread portion has a pitch substantially the same as that of the convolutions of said hose when the latter is unstressed.

13. The hose connection of claim 10, in which said abutment comprises a collar extending radially outwardly from said tubular portion.

* * * * *